US009157310B2

(12) United States Patent
Estes et al.

(10) Patent No.: US 9,157,310 B2
(45) Date of Patent: Oct. 13, 2015

(54) TRIPPING INDICATOR FOR MWD SYSTEMS

(75) Inventors: Robert A. Estes, Tomball, TX (US); Jonathan R. Bynum, Marshall, TX (US)

(73) Assignee: Baker Hughes Incorporated, Houston, TX (US)

( * ) Notice: Subject to any disclaimer, the term of this patent is extended or adjusted under 35 U.S.C. 154(b) by 761 days.

(21) Appl. No.: 12/345,173

(22) Filed: Dec. 29, 2008

(65) Prior Publication Data

US 2009/0173538 A1 Jul. 9, 2009

Related U.S. Application Data

(60) Provisional application No. 61/019,087, filed on Jan. 4, 2008.

(51) Int. Cl.
*E21B 47/00* (2012.01)
*E21B 44/00* (2006.01)

(52) U.S. Cl.
CPC ..... *E21B 47/00* (2013.01); *E21B 44/00* (2013.01)

(58) Field of Classification Search
CPC ..... E21B 44/00; E21B 44/005; E21B 47/00; E21B 47/12
USPC ..... 702/6; 175/24, 40
See application file for complete search history.

(56) References Cited

U.S. PATENT DOCUMENTS

| | | | | |
|---|---|---|---|---|
| 2,345,770 | A * | 4/1944 | Stafford | 33/313 |
| 4,535,972 | A | 8/1985 | Millheim et al. | |
| 5,210,533 | A * | 5/1993 | Summers et al. | 340/853.4 |
| 5,402,677 | A | 4/1995 | Paslay et al. | |
| 5,589,825 | A * | 12/1996 | Pomerleau | 340/854.9 |
| 5,660,238 | A * | 8/1997 | Earl et al. | 175/40 |
| 5,812,068 | A * | 9/1998 | Wisler et al. | 340/855.5 |
| 6,375,275 | B1 * | 4/2002 | Smith et al. | 303/3 |
| 6,543,280 | B2 * | 4/2003 | Duhon | 73/152.01 |
| 6,631,563 | B2 * | 10/2003 | Brosnahan et al. | 33/313 |
| 7,002,484 | B2 | 2/2006 | McElhinney | |
| 7,168,508 | B2 | 1/2007 | Goldberg et al. | |
| 7,171,334 | B2 * | 1/2007 | Gassner | 702/182 |
| 2002/0116130 | A1 | 8/2002 | Estes et al. | |
| 2004/0040746 | A1 * | 3/2004 | Niedermayr et al. | 175/38 |
| 2006/0087449 | A1 | 4/2006 | Radzinski | |
| 2006/0272861 | A1 * | 12/2006 | Hutchinson | 175/50 |
| 2008/0000688 | A1 * | 1/2008 | McLoughlin et al. | 175/40 |
| 2008/0190605 | A1 | 8/2008 | Clapp et al. | |

FOREIGN PATENT DOCUMENTS

| | | |
|---|---|---|
| WO | WO9509296 | 4/1995 |

OTHER PUBLICATIONS

Product Information Web Page, Weatherford International Ltd., 2006, http://www.weatherford.com/Products/Evaluation/OpenHoleServices/Imaging/.*

* cited by examiner

*Primary Examiner* — Alexander Satanovsky
(74) *Attorney, Agent, or Firm* — Cantor Colburn LLP

(57) ABSTRACT

A method for surveying a formation includes conveying a survey instrument into the wellbore; measuring one or more parameters of interest relating to a wellbore tubular in the wellbore; and operating the survey instrument after the measured parameter of interest indicates that the wellbore tubular is being tripped out of the wellbore.

20 Claims, 3 Drawing Sheets

TRIPPING INDICATOR FOR MWD SYSTEMS

CROSS-REFERENCE

This application takes priority from U.S. Provisional Application Ser. No. 61/019,087, file Jan. 4, 2008.

FIELD OF THE DISCLOSURE

1. Field of the Disclosure

The disclosure relates to a method and an apparatus for the acquiring information relating to subterranean formations and wellbores intersecting such formations.

2. Background of the Disclosure

Hydrocarbons are recovered from underground reservoirs using wellbores drilled into the formation bearing the hydrocarbons. Prior to and during drilling, extensive geological surveys are taken to increase the likelihood that the drilled wellbore intersects the formations of interest in a desired manner.

Typically, surveys of drilled wells are done by determining the actual displacement coordinates (north, east, vertical) at the bottom of a conveyance devices such as a wireline or tubing string, which are derived from incremental azimuth and inclination values. In one conventional method, a wireline truck or other surface platform lowers a directional instrument into the well. As the instrument travels in the well, it takes taking measurements of angular orientation at discrete intervals. Data is communicated to the surface by wireline in real time and/or data is extracted from the instrument at the surface by accessing a resident memory module. In another conventional method, survey instruments in a bottomhole assembly (BHA) may perform surveys as the BHA drills the wellbore.

Because surveys may play a significant role in the efficient recovery of subsurface hydrocarbons, it may be desirable to accumulate as much survey data as possible for a given well. The present disclosure addresses the need to efficiently obtain surveys and other information relating to the wellbore.

SUMMARY OF THE DISCLOSURE

In aspects, the present disclosure provides a method for surveying a formation having a wellbore. The method may include conveying a survey instrument into the wellbore; measuring a parameter of interest relating to a wellbore tubular in the wellbore; and operating the survey instrument after the measured parameter of interest indicates that the wellbore tubular is being tripped out of the wellbore. The parameters of interest may include, but are not limited to, acceleration and rotational speed. The survey instrument may be a gyroscopic survey instrument, a magnetometer, an accelerometer, a plumb bob, a magnetic directional survey instrument, or any other suitable device configured to measure desired parameters. In embodiments, the step of operating the survey instrument may include taking a survey. The survey may include obtaining values for azimuth and inclination. Also, the survey may be performed at a plurality of discrete locations using the survey instrument. In embodiments, the survey instrument may be operated after determining that the wellbore tubular has stopped rotating, no fluid is being pumped along a bore of the wellbore tubular, or the wellbore tubular is being moved axially. In further embodiments, the method may include measuring a plurality of parameters of interest and operating the survey instrument after detecting a change in values of the plurality of parameters of interest. Additionally, the method may include determining a sequence for the changes in values in the plurality of parameters of interest. The survey instrument may be operated after the sequence is determined to correspond to a predetermined sequence.

In aspects, the present disclosure provides a system for surveying a formation having a wellbore. The system may include a wellbore tubular; a survey instrument positioned on the wellbore tubular; a sensor positioned on the tubular, and a processor coupled to and receiving data from the sensor, the processor including executable instructions for operating the survey instrument after the data for the sensor interest indicates that the wellbore tubular is being tripped out of the wellbore. The sensor may be configured to measure a parameter of interest relating to a wellbore tubular in the wellbore such as acceleration or rotational speed. The survey instrument may be a gyroscopic survey instrument, a magnetometer, an accelerometer, a plumb bob, or a magnetic directional survey instrument. The processor may be programmed to operate the survey instrument after determining that the wellbore tubular has stopped rotating, no fluid and/or being pumped along a bore of the wellbore tubular, and the wellbore tubular is being moved axially. The processor may also be programmed with a predetermined sequence for the changes in values in the plurality of parameters of interest, and to operate the survey instrument after the sequence is determined to correspond to a predetermined sequence.

In aspects, the present disclosure provides a computer-readable medium accessible to a processor. The computer-readable medium may include instructions that enable the processor to determine whether or not a wellbore tubular is being tripped out of the wellbore based on at least one measured parameter of interest relating to the wellbore tubular and which enable the processor to operate a survey after determining that the wellbore tubular is being tripped out of the wellbore.

Examples of the certain illustrative features of the disclosure have been summarized (albeit rather broadly) in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE FIGURES

For detailed understanding of the present disclosure, reference should be made to the following detailed description of the preferred embodiment, taken in conjunction with the accompanying drawing.

DETAILED DESCRIPTION OF THE DISCLOSURE

Figure 1:
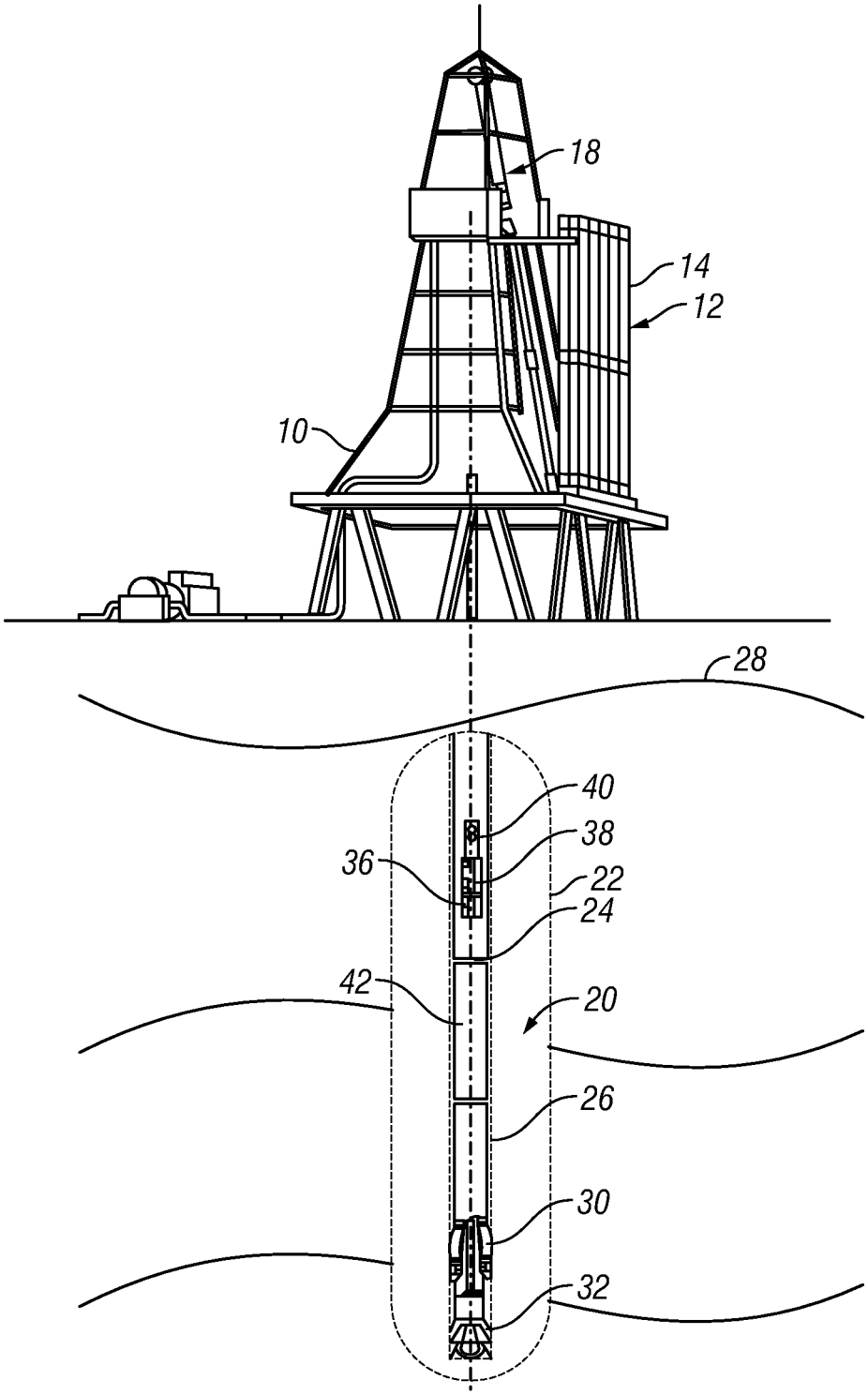
FIG. 1 schematically illustrates an elevation view of a drilling system utilizing downhole depth measurement in accordance with one embodiment of the present disclosure.

The present disclosure relates to devices and methods for self-initiated or automated activation of downhole sensors while tripping into or out of a wellbore. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Referring initially to FIG. 1, there is shown a conventional drilling tower 10 for performing one or more operations related to the construction, logging, completion or work-over of a hydrocarbon producing well. While a land well is shown, the tower or rig can be situated on a drill ship or another suitable surface workstation such as a floating platform or a semi-submersible for offshore wells. The tower 10 includes a stock 12 of tubular members generally referred to as drill string 20 segments 14, which are typically of the same and predetermined length. The tubulars 14 can be formed partially or fully of drill pipe, metal or composite coiled tubing, liner, casing or other known members. Additionally, the tubulars 14 can include a one way or bi-directional communication link utilizing data and power transmission carriers such fluid conduits, fiber optics, and metal conductors. The tubulars 14 are taken from the rod stock 12 by means of a hoist or other handling device 18 and are joined together to become component parts of the drill string 20. In embodiments, the tubular 14 may be "stands." As is known, a stand may include a plurality of pipe joints (e.g., three joints). At the bottom of the drill string 20 is a bottomhole assembly (BHA) 22 illustrated diagrammatically in the broken-away part 24 that is adapted to form a wellbore 26 in the underground formation 28. The BHA includes a housing 30 and a drive motor (not shown) that rotates a drill bit 32.

The BHA 22 includes hardware and software to provide downhole "intelligence" that processes measured and preprogrammed data and writes the results to an on-board memory and/or transmits the results to the surface. In one embodiment, a processor 36 disposed in the housing 30 is operatively coupled to one or more downhole sensors (discussed below) that supply measurements for selected parameters of interest including BHA or drill string 20 orientation, formation parameters, and borehole parameters. The BHA can utilize a downhole power source such as a battery (not shown), power transmitted from the surface via suitable conductors, a downhole power generator such as a turbine or other suitable power source. The processor 36 may include a memory module 38 to which data may be written and may be programmed with instructions that evaluate and process measured parameters.

In embodiments, the BHA 22 may include sensors, generally referenced with numeral 40 that, in part, measures acceleration in the x-axis, y-axis, and z-axis directions. For convenience, the x-axis and y-axis directions describe movement orthogonal to the longitudinal axis of the drill string 20, and the z-axis direction describes movement parallel to the longitudinal axis of the drill string 20. In one suitable arrangement, the package uses a two axis gyro and three accelerometers to provide the necessary data for orientation in a magnetic environment. One such package or module, GYROTRAK, is made by BAKER HUGHES INCORPORATED. Additionally, a magnetometer, which measures the strength or direction of the Earth's magnetic, can be used when the BHA 22 is outside of the magnetic environment, i.e., in open hole. Other instruments include mechanical devices such as plumb bobs and electronic equipment such as magnetic directional survey equipment. These sensors and instruments may provide measurements for determining coordinates and positions; i.e., north, east and vertical, of the BHA 22 in the wellbore. As used herein the term "north" refers to both magnetic north and geographic north.

The BHA 22 may also include a measurement-while-drilling system ("MWD") 42 that may include one or more sensors or tools for evaluating one or more parameters for the formation being drilled. Such sensors may include electromagnetic propagation sensors for measuring the resistivity, dielectric constant, or water saturation of the formation, nuclear sensors for determining the porosity of the formation and acoustic sensors to determine the formation acoustic velocity and porosity. Other downhole sensors that have been used include sensors for determining the formation density and permeability. The BHA may also include pressure sensors, temperature sensors, gamma ray devices, acoustic and resistivity devices for determining bed boundaries, and nuclear magnetic resonance ("NMR") sensors for providing direct measurement for water saturation porosity and indirect measurements for permeability and other formation parameters of interest. As noted previously, the BHA may also include devices to determine the BHA inclination and azimuth and devices that aid in orienting the drill bit in a particular direction. In embodiments, the BHA 22 may be configured to measure one or more parameters of interest, write data indicative of the measured parameter(s) to memory, and/or periodically transmit some or all of the data to the surface.

It should be understood that the BHA 22 is merely representative of wellbore tooling and equipment that may utilize the teachings of the present disclosure.

In one operating mode, the processor 36 may be programmed to acquire data using the MWD system 42 while the BHA 22 is drilling the wellbore. The processor 36 may operate the sensors as needed to acquire measurements and record those measurements to memory. Additionally, the processor 36 may be programmed to periodically transmit measured data to the surface during drilling, during specified events and/or in response to a communication downlinks. In embodiments, a mud pulse telemetry system may be used to transmit uplinks and downlinks.

In another mode of operation, the processor 36 may be programmed to automatically acquire data using the MWD system 42 while the BHA 22 is tripped out of the wellbore. Periodically, the drill string 20 may be pulled out of the wellbore to replace a worn drill bit, repair or replace equipment, to perform a completion operation, etc. Typically, during tripping out of the wellbore, high pressure drilling fluid is not circulated in the wellbore. Thus, mud pulse based telemetry may not be available to transmit communication downhole to control operation of the MWD system 42 or transmit data uphole. In such instances where the BHA 22 is being tripped out of the wellbore, the processor 36 may be programmed to utilize data from one or more sensors to autonomously control operation of the MWD system 42 in a manner that captures MWD system 42 measurements without wasting memory space and/or battery capacity. Exemplary embodiments are discussed below.

In one embodiment, the processor 36 may be programmed to periodically or continuously process sensor data to determine whether a tripping operation has commenced or is under way. For example, the processor 36 may be programmed to detect changes in downhole certain operating characteristics that would indicate the cessation of normal drilling and to detect certain other operating characteristics that indicate the beginning of tripping the drill string 20 out of the wellbore.

Figure 2:
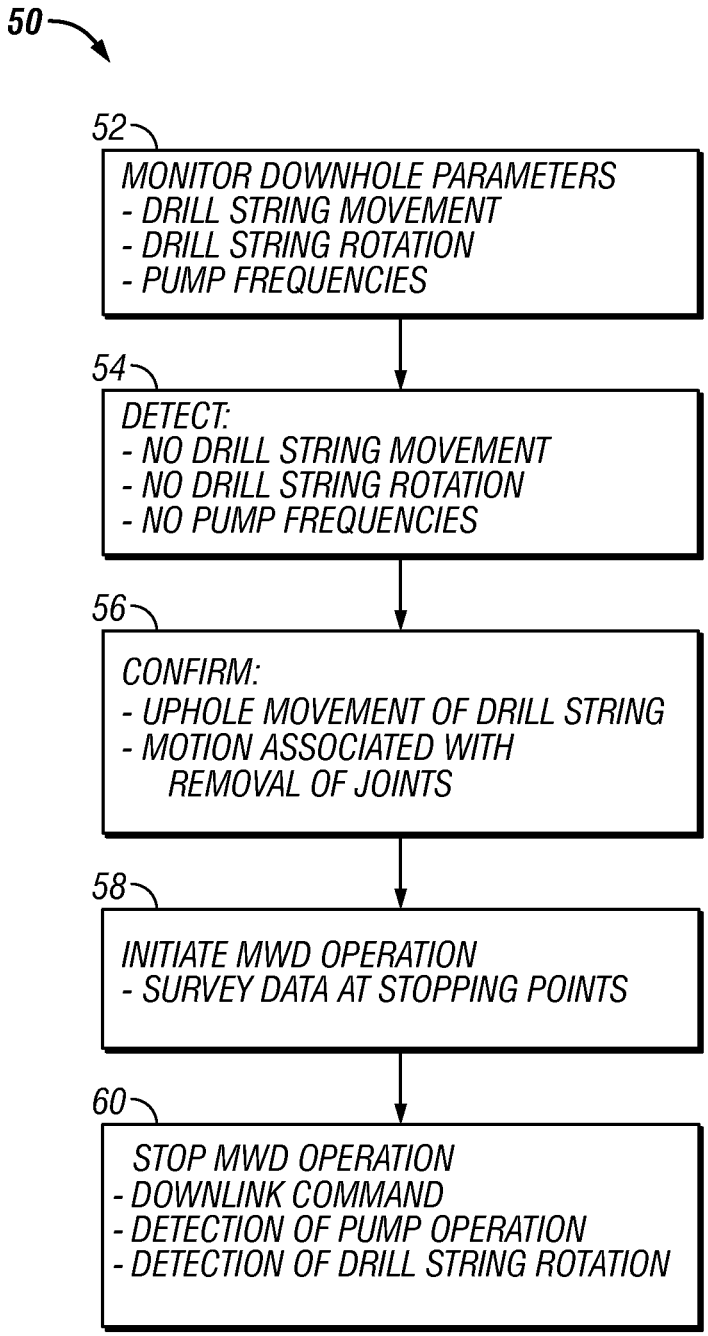
FIG. 2 is a flow chart illustrating one embodiment of a method for operating an MWD system while tripping.

Referring now to FIGS. 1 and 2, in one illustrative method 50, the processor 46 at step 52 continuously monitors sensor measurements for conditions associated with the stopping of pump operation and the stopping of rotation of the drill string 20. Suitable sensors for such monitoring include, but are not limited to, sensors such as accelerometers, magnetometers and gyroscopes. For example, the processor 46 may be programmed to perform fast Fourier transforms (FFT) on the accelerometer measurements to determine whether a pump fundamental frequency, ordinarily between 0.3 to 4 Hz, is present and is above a predetermined threshold. Detection of such frequencies indicates operation of the surface pumps. Magnetometers readings may give an indication that the drill string 20 is rotating. Also, accelerometers measurements give an indication that the drill string is moving axially or laterally. All of these conditions, if present, would indicate that the BHA 22 is in a drilling operating mode.

At step 54, the processor 46 may determine that one or more sensor measurements are not consistent with that of the drilling mode of operation. For instance, the processor 46 may receive sensor measurements that indicate the cessation of pump operation, the cessation of rotation of the drill string 20, and/or the reduction in axial or lateral movement of the drill string 20. The absence a pump operating frequency may indicate that the surface pumps have stopped operating; e.g., the FFT computations may indicate that pump fundamental frequencies are not present in the drill string 20. The processor 46 may be programmed to not only monitor confirm the cessation of pump operation for a predetermined time period (e.g., thirty seconds). Axial and/or z axis accelerometers may provide measurements that indicate no movement of the drill string 20 for a predetermined time period or an upward motion. Additionally, the sequence in which these events are detected may also be utilized to determine whether a tripping operation may be imminent; e.g., a reduction in axial movement, followed by no drill string rotation, followed by no pump operation. That is, the processor 46 may be programmed to no only monitor downhole parameters, but also the order or sequence in which changes to those parameters occur. The processor 46 may use a quiescent average value, an average value for the uphole direction, and/or integrated depth motion for the uphole direction, in evaluating or characterizing these accelerometer measurements. It will be appreciated that, because variances in the magnitude of vibration of motion can occur during normal drilling operations, standard deviations may be applied for the output of these sensors to determine whether the measurements are within a range associated with drilling operations or are indicative of an interruption in drilling operation. It should be understood that these listed parameters and thresholds are merely illustrative of the types of parameters and thresholds that may be utilized to determine whether a drilling mode of operation exists. For example, pressure sensors may also be utilized to detect changes in fluid pressure that may indicate a change in operating modes.

At step 56, the processor 46 may perform additional evaluations to confirm the start of the tripping operation. For example, the processor 46 may re-evaluate axial accelerometer measurements to determine whether drill string is, in fact, moving in an uphole direction. Additionally, the processor 46 may utilize accelerometer measurements to identify a sequence of movements that indicate that stands or joints are being removed from the drill string 20; e.g., uphole movement of the drill string, limited uphold and downhole movement, a quiet period, limited uphold and downhole movement, uphold movement of the drill string, etc. In embodiments, the processor 46 may utilize one or more databases (not shown) to assist in determining whether the BHA 22 is in a tripping mode. For purposes of this disclosure, the point at which the drill string 20 is being tripped out of the wellbore may be considered the initiation of any activity or action, including preparatory actions such as stopping drill string rotation and stopping the pumping of drilling fluid, that are typically taken prior to actually pulling the drill string 20 out of the wellbore. That is, the tripping mode may begin well before the drill string 20 is moved axially uphole. The databases may include data relating to the successive depths of collars along a well casing or survey data relating to the thickness of particular geological layers in a formation. Generally speaking, the measured parameters may relate to human made features such as wellbore tooling/equipment and wellbore geometry or naturally occurring features such as formation lithology. One or more sensors may provide the downhole processor 36 with measurements that may be used to query the databases to confirm that the BHA 22 is traveling in a particular direction (e.g., uphole).

Once measurements and the values of any computations using such measurements meet predetermined values, the processor 46 may initiate operation of the MWD system 42 at step 58. In arrangements, the processor 46 may operate the MWD system 42 by energizing one or more directional and formation evaluation sensors. For example, a gyroscopic sensor may be continuously energized to detect motionless periods between stands of pipe and to make a gyrocompass survey during such motionless periods and record the survey results to memory. The processor 46 may be programmed to energize and de-energize the sensors as needed or keeps the sensors continuously energized. Maintaining a continuous powered sensor may reduce transients associated with a powering up condition that would otherwise affect sensor accuracy and reduce the total time required to obtain a survey.

In arrangements, the processor 46 may be programmed to terminate operation of the MWD system 42 at step 60. In some arrangements, the processor 46 may continually monitor sensor measurements to detect events associated with a disruption of the tripping operation. For example, the processor 46 may detect that the surface pumps have been turned on. Also, in arrangements, the processor 46 may terminate operation of the MWD system 42 in response to a predefined "stop" signal applied at the surface by an operator on the rig floor. For example, a magnetic rotation simulator or a vibrating pump simulator may transmit a signal that may be detected by the sensors of the MWD system 42. Any of these methods may be utilized to have the processor 46 exit the acquisition of survey data in the tripping mode of operation.

Figure 3:
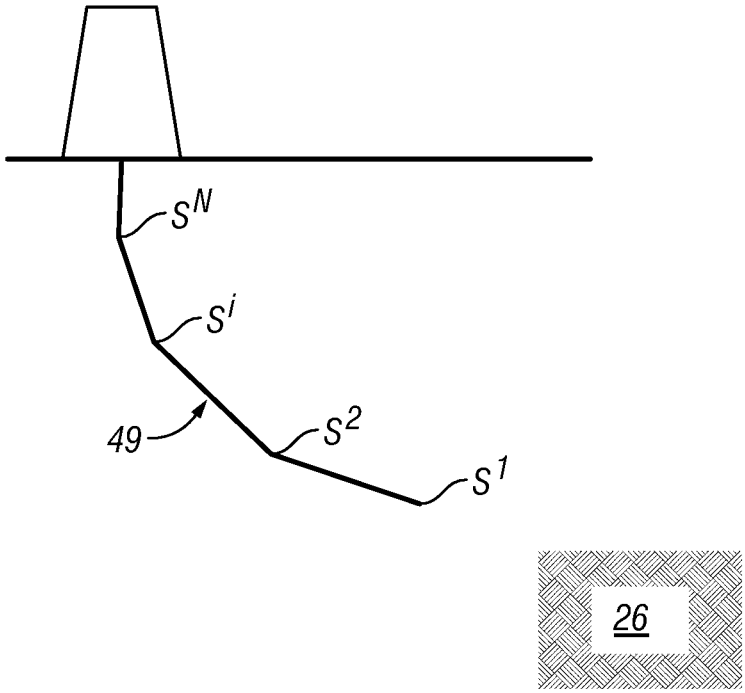
FIG. 3 illustrates a wellbore trajectory having discrete survey points.

Referring now to FIGS. 1 and 3, there is shown a wellbore 26 drilled in an earthen formation 49 by a BHA 22. The BHA 22 is shown at position $S^1$, the position at which drilling is terminated. As the BHA 22 is tripped out of the wellbore, drill string motion is periodically interrupted to remove lengths of pipe 14 from the drill string 20. Exemplary stopping positions are labeled $S^1$, $S^2$, $S^3$, $S^i$, and $S^n$, for convenience. Initially, at position $S^1$, the processor 46, based on the sensor measurements in the BHA 22, determines that drilling has stopped and initiates limited or full operation of the MWD system 42. In one mode of operation, the MWD system 42 surveys the formation as the BHA 22 moves from stopping point to stopping point; e.g., $S^1$ to $S^2$. At each point $S^i$, the processor 36 initiates a directional survey using the on-board direction sensors 40. These sensors 40 can be used to determine north, east, and inclination of the BHA 22. The survey data may then be associated or correlated with the determined depth at each location $S^i$. These "snapshot" survey stations with their time-of-day data in memory are written to the onboard memory module 38 and/or transmitted to the surface.

From the above, it should be appreciated that a method of surveying has been described wherein, while the pipe is not moving, a downhole processor performs depth measurement calculations and initiates a static orientation survey station. In casing, the surveys use a gyroscopic survey instrument such as the GYROTRAK tool whereas in open hole a magnetometer may be utilized. The processor computes incremental north, east, and down displacements for the BHA course length based on the inclination and azimuth computed at the beginning and the end of the tubular joint. Thereafter, a summation of the incremental north, east and down displacements produces a set of present total displacement figures for the BHA. The calculations can also be used to determine other values such as true vertical depth. The processor stores the accumulated displacements in the memory module in the downhole MWD/Survey tool.

It should be understood that the teachings of the present disclosure are not limited to tooling conveyed by rigid carriers such as drill strings, such as that shown in FIG. 1. In embodiments, the above-described methods and devices may be employed on non-rigid carriers such as slick lines. In still other embodiments, the above-described methods and devices may be used in connection with drop survey devices that are released into the wellbore.

The above-described methods and devices in certain embodiments may be employed with devices that take substantially continuous survey measurements of the wellbore. In contrast to discrete intervals for takings surveys, as described in connection with FIG. 3, the processor 36 (FIG. 1) may continuously obtain directional survey data using the on-board direction sensors 40. This survey data with their time-of-day data in memory may be written to the onboard memory module 38 and/or transmitted to the surface. Also, such an arrangement may be used tooling conveyed with a non-rigid carrier (slickline) or tooling dropped into a wellbore, i.e., a drop survey tool. The wellbore tool may also be conveyed by an autonomous wellbore drilling tool such as a tractor device or drilling machine.

Figure 4:
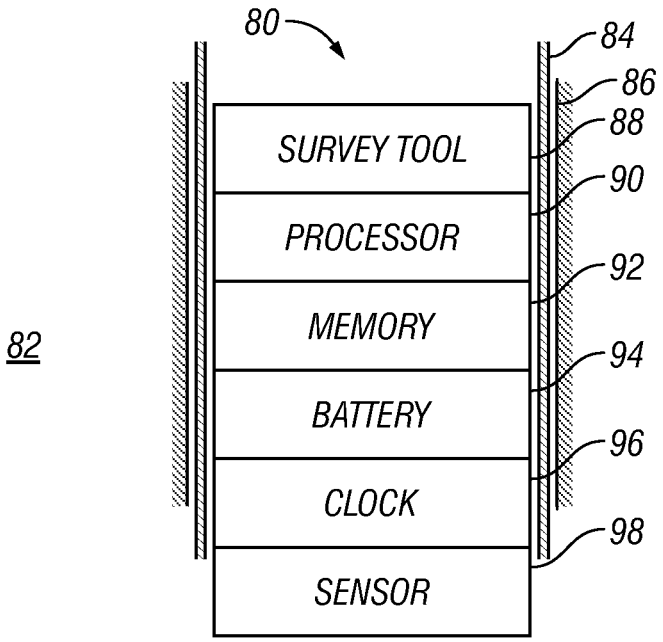
FIG. 4 illustrates one embodiment of a survey tool made in accordance with the present disclosure that traverses a wellbore under the effect of gravity.

Referring now to FIG. 4, there is shown a drop tool 80 that may be used to survey a formation 82. In one embodiment, the drop tool 80 free falls within a bore of a tubing 84, which may be a part of the drill string 20 (FIG. 1), that is positioned in a drilled wellbore 86. During descent, the drop tool 80 may perform surveys of the wellbore 86. The drop tool 80 may be configured to land on a suitable receiving device (not shown) in the drill string 20 (FIG. 1). Thereafter, while the drill string 20 (FIG. 1) is pulled out of the wellbore 86, the drop tool 80 may perform surveys of the wellbore 86. In one embodiment, the drop tool 80 may include a survey tool 88 that includes any of the previously described sensors, such a directional survey sensors and formation evaluation sensors. The drop tool 80 may also include a processor 90, a memory 92, a battery 94, and a clock 96. In a manner previously discussed, the processor 90 may be programmed to control operation of the survey tool 88 as a function of the movement of the drop tool 80. In some embodiments, the sensors of the survey tool 88 may be utilized to determine whether a tripping operation is imminent or is occurring. In other embodiments, a separate sensor 98 may be used by the processor 88 for making such determinations. Such an arrangement may be advantageous, for example, if the separate sensor 96 can be configured to impose a lower power drain on the battery 94 that the survey tool 88.

Thus, it should be appreciated that what has been disclosed includes at least a method for surveying a formation having a wellbore. This method may include conveying a survey instrument into the wellbore, measuring a parameter of interest relating to a wellbore tubular in the wellbore, and operating the survey instrument after the measured parameter of interest indicates that the wellbore tubular is being tripped out of the wellbore. The parameter of interest may include acceleration and/or rotational speed. The survey instrument(s) may be a gyroscopic survey instrument, a magnetometer, an accelerometer, a plumb bob, and/or a magnetic directional survey instrument. The survey instrument may be operated to take a survey, which may include measuring values for azimuth and inclination. The survey may be performed at a plurality of discrete locations using the survey instrument. The method may include operating the survey instrument after determining that: the wellbore tubular has stopped rotating, no fluid is being pumped along a bore of the wellbore tubular, and/or the wellbore tubular is being moved axially. Also, the method may include measuring a plurality of parameters of interest and operating the survey instrument after detecting a change in values of the plurality of parameters of interest. In aspects, the method may include determining a sequence for the changes in values in the plurality of parameters of interest, and operating the survey instrument after the sequence is determined to correspond to a predetermined or selected sequence.

It should also be appreciated that what has been disclosed includes at least a system for surveying a formation having a wellbore. The system may include a wellbore tubular; a survey instrument positioned on the wellbore tubular; a sensor positioned on the tubular that measures a parameter of interest relating to a wellbore tubular in the wellbore; and a processor coupled to and receiving data from the sensor. The processor may include executable instructions for operating the survey instrument after the data for the sensor interest indicates that the wellbore tubular is being tripped out of the wellbore.

It should be appreciated that what has been disclosed includes at least a computer-readable medium accessible to a processor. The computer-readable medium may include instructions that enable the processor to determine whether or not a wellbore tubular is being tripped out of the wellbore based on at least one measure parameter of interest relating to the wellbore tubular and which enable the process to operate a survey response upon determining that the wellbore tubular is being tripped out of the wellbore. The medium may utilize least one of: (i) a ROM, (ii) an EPROM, (iii) an EEPROM, (iv) a flash memory, and (v) an optical disk.

While the foregoing disclosure is directed to the preferred embodiments of the disclosure, various modifications will be apparent to those skilled in the art. It is intended that all variations within the scope of the appended claims be embraced by the foregoing disclosure.

What is claimed is:

1. A method for surveying a formation having a wellbore, comprising:

conveying a wellbore tubular having a survey instrument into the wellbore;

monitoring a plurality of drilling parameters at a downhole sensor of the wellbore tubular in the wellbore to determine an order in which changes are made to the plurality of drilling parameters and to measure time periods associated with the changes to the plurality of drilling parameters;

determining at a downhole processor a sequence of changes to the plurality of drilling parameters that indicates commencement of tripping of the wellbore tubular out of the wellbore, wherein the sequence includes predetermined time periods associated with the changes to the drilling parameters; and using the downhole processor to energize the survey instrument when the order in which changes are made to the plurality of drilling parameters and the associated time periods matches the sequence indicating commencement of tripping of the wellbore tubular out of the wellbore.

2. The method of claim 1, wherein the plurality of drilling parameters includes at least one of: (i) acceleration, and (ii) rotational speed.

3. The method of claim 1, wherein the survey instrument is one of: (i) a gyroscopic survey instrument, (ii) a magnetometer, (iii) an accelerometer, (iv) a plumb bob, and (v) a magnetic directional survey instrument.

4. The method of claim 1, further comprising operating the survey instrument to take a survey.

5. The method of claim 4, wherein taking the survey includes obtaining values for azimuth and inclination.

6. The method of claim 4, wherein taking the survey comprises taking the survey at a plurality of discrete locations using the survey instrument.

7. The method of claim 1, wherein the sequence indicating commencement of tripping includes: (i) stopping axial movement of the wellbore tubular, followed by (ii) stopping rotation of the wellbore tubular, followed by (iii) stopping pumping of fluid along a bore of the wellbore tubular, following by (iv) moving the wellbore tubular in an uphole direction.

8. The method of claim 7, wherein the sequence further includes cessation of pumping of fluid for a first pre-determined amount of time and stopping the axial movement of the wellbore tubular for a second pre-determined amount of time.

9. The method of claim 8 wherein the first pre-determined amount of time is thirty seconds.

10. A system for surveying a formation having a wellbore, comprising:

a wellbore tubular;

a survey instrument positioned on the wellbore tubular;

at least one sensor positioned on the wellbore tubular configured to monitor one or more drilling parameters at the wellbore tubular at a downhole location in the wellbore; and a downhole processor configured to:

receive data from the at least one sensor related to the one or more drilling parameters;

determine from the data an order in which changes are made to the one or more drilling parameters and time periods associated with the changes to the one or more drilling parameters;

determine a sequence of changes to the one or more of drilling parameters that indicates a commencement of tripping of the wellbore tubular out of the wellbore, wherein the sequence includes pre-determined time periods associated with the changes to the drilling parameters; and energize the survey instrument when the order in which changes are made to the one or more drilling parameters and the associated time periods matches the sequence indicating that the wellbore tubular is commencing tripping out of the wellbore.

11. The system of claim 10, wherein the one or more drilling parameters includes at least one of: (i) acceleration, and (ii) rotational speed.

12. The system of claim 10, wherein the survey instrument is one of: (i) a gyroscopic survey instrument, (ii) a magnetometer, (iii) an accelerometer, (iv) a plumb bob, and (v) a magnetic directional survey instrument.

13. The system of claim 10, wherein the sequence indicating commencement of tripping includes: (i) stopping axial movement of the drill string, followed by (ii) stopping rotating of the wellbore tubule, followed by (iii) stopping pumping of fluid along a bore of the wellbore tubular, following by (iv) moving the wellbore tubular in an uphole direction.

14. The system of claim 13, wherein the sequence further includes cessation of pumping of fluid for a first pre-determined amount of time and stopping the axial movement of the wellbore tubular for a second pre-determined amount of time.

15. A non-transitory computer-readable medium accessible to a downhole processor, the non-transitory computer-readable medium including instructions which enable the downhole processor to:

determine a sequence of changes to a plurality of drilling parameters that indicates commencement of tripping of a wellbore tubular out of the wellbore, wherein the sequence includes pre-determined time periods associated with the changes to the plurality of drilling parameters;

monitor the plurality of drilling parameters at a downhole sensor of the wellbore tubular to determine an order in which changes are made to the plurality of drilling parameters and to measure time periods associated with the changes to the plurality of drilling parameters; and energize a survey instrument when the order in which changes are made to the plurality of drilling parameters and the associated time periods matches the sequence indicating commencement of tripping of the wellbore tubular out of the wellbore.

16. The non-transitory computer-readable medium of claim 15, wherein the instructions include for the processor to operate the survey instrument to take survey data after the commencement of tripping.

17. The non-transitory computer-readable medium of claim 15, wherein the survey data includes data from at least one of: (i) a gyroscopic survey instrument, (ii) a magnetometer, (iii) an accelerometer; (iv) a plumb bob, and (v) a magnetic directional survey instrument.

18. The non-transitory computer-readable medium of claim 15, wherein the computer-readable is one of: (i) a ROM, (ii) an EPROM, (iii) an EEPROM, (iv) a flash memory, and (v) an optical disk.

19. The non-transitory computer-readable medium of claim 16, wherein the survey data includes data relating to azimuth and inclination.

20. The non-transitory computer-readable medium of claim 15, wherein the sequence indicating commencement of tripping includes: (i) stopping axial movement of the wellbore tubular, followed by (ii) stopping rotation of the wellbore tubular, followed by (iii) stopping pumping of fluid along a bore of the wellbore tubular, following by (iv) moving the wellbore tubular in an uphole direction.

* * * * *